United States Patent [19]

Lindbergh

[11] 4,236,605

[45] Dec. 2, 1980

[54] VARIABLE COUNTERWEIGHT SYSTEM

[76] Inventor: Charles Lindbergh, 10 S. Basilica, Charleston, S.C. 29406

[21] Appl. No.: 933,886

[22] Filed: Aug. 15, 1978

[51] Int. Cl.[3] ..... B66B 17/12

[52] U.S. Cl. .....187/94; 74/89.22

[58] Field of Search ..... 187/94; 254/178, 190 R

[56] References Cited

U.S. PATENT DOCUMENTS

| | | | |
|---|---|---|---|
| 325,168 | 8/1885 | Gornall | 187/94 |
| 736,234 | 8/1903 | Delp | 254/178 |
| 947,585 | 1/1910 | Ashton, Sr. | 187/94 |
| 1,073,700 | 9/1913 | Neenan | 187/94 |
| 1,898,711 | 2/1933 | Borgen | 187/94 |

FOREIGN PATENT DOCUMENTS

| | | | |
|---|---|---|---|
| 730256 | 5/1955 | United Kingdom | 187/94 |

*Primary Examiner*—Stanley H. Tollberg
*Assistant Examiner*—Kenneth Noland
*Attorney, Agent, or Firm*—Newton, Hopkins & Ormsby

[57] ABSTRACT

A movable load exerts varying static and dynamic forces which need to be counteracted with a minimum expenditure of energy. A counterweight connected to the movable load has its counterweighting effectiveness varied as a function of the position of components which make up the counterweight to adapt the counterweight to the varying forces exerted by the load during movement of the load.

12 Claims, 18 Drawing Figures

III

II

I

I

II

III
A
B
C
1
2
3
4
4a
4b
4c
5

G
200
215
216
217
218
219
220
201
201a
201b
202
203
204
205
205a
205b
206
207
208
209
210
211
212
213
214
222
223
225

VARIABLE COUNTERWEIGHT SYSTEM

This invention relates to a counterweight system comprising a counterweight connected to a movable load to compensate varying dynamic and/or static forces exerted by this load as a known function of its position.

In such a counterweight system, varying dynamic forces may arise from the accelerations and decelerations of the load and of the other movable parts. Varying static forces are generated for instance when the load, rather than being linearly raised or lowered, is rotated about a horizontal axis.

In ordinary counterweight systems, the effective weight (and hence mass) of the counterweight is constant. Therefore complete balancing of the forces is possible as best only for a single condition. Generally however additional requirements must be met, which further appreciably restrict the possibility of an optimal balancing of the forces. As regards a load which upon being raised should descend under its own weight, no complete balancing of forces may take place, for instance, as otherwise a dead point shall arise. Again when load and counterweight are suspended from a cable, it must be borne in mind that this cable can only transmit tensional, but not compressive forces.

Therefore outside energy must in general be applied to the known counterweight systems, for instance when raising the load, so as to compensate the difference in weight between load and counterweight and also to generate the required acceleration. While this energy is converted into potential or kinetic energy, neither can be wholly recovered within the system nor ordinarily be fed back to an external energy source. It is lost in braking. This loss in energy is particularly unpleasantly noticeable when large loads must be moved at long time intervals, but then as quickly as possible. In order to deliver the required energy within the desired short time, engines of high output must be installed, which are poorly utilized on account of the low frequency of operation.

The object of the invention is to create a counterweight system minimizing the required supply of external energy.

The invention solves this problem in making the effective weight of the counterweight a function of its position so as to balance it with the changing static and dynamic forces.

The counterweight system of the invention allows optimally compensating all the static and dynamic forces that arise provided these forces vary as a known function, which is the same for every cycle of motion of the load's path, whereby the system consisting of load and counterweight at any time is precisely or at least very nearly in equilibrium. This equilibrium also applying to the dynamic forces (accelerations), no appreciable external force is required to set the system in motion. The kinetic and/or potential energies being generated are entirely recovered within the system, and the supply of external energy is restricted to making good the losses arising from friction, air resistance, etc.

The energy required to set the load in motion being converted within the system, it is also immaterial within what time this energy is converted; the internal power of the system therefore may be arbitrarily large, without this being reflected externally. Accordingly the counterweight system of the invention allows moving very high loads in very short times, without requiring large-power machinery. The output of the installation of the invention is restricted to that energy which will replenish the losses within the available time. Using advantageous embodiments of the invention, it is possible to supply the energy required to cover these losses during relatively long operational pauses and to store it, so that very low power suffices to this end.

A preferred embodiment of the counterweight system of the invention comprises several partial weights in the counterweight, which are detachably connected to the load, further devices which separate individual partial weights from the load at predetermined points of the path of the counterweight.

Further characteristics and advantages of the invention are discussed in the description below the embodiments and in relation to the drawing.

Figure 1:
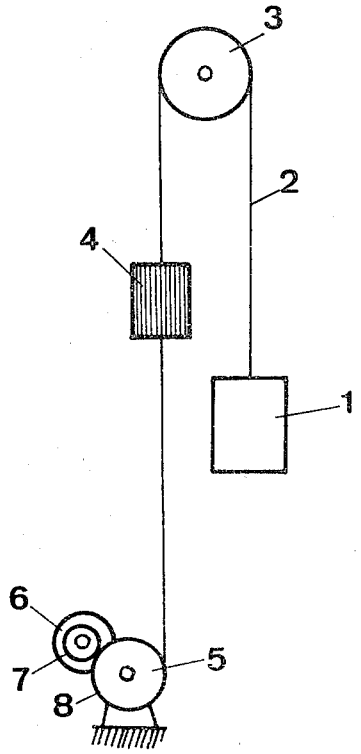
PRIOR ART Fig.1
FIG. 1 is a schematic of a known counterweight system with constant counterweight.

FIG. 1 shows a constant-weight load suspended from a cable 2 guided over a pulley 3 and passing to a winch 5 driven from an electric motor 6 by means of gearing consisting of a motor pinion 7 and a gear 8. To decrease the energy required to raise the load 1, a counterweight again of constant weight is mounted in the section between pulley 3 and winch 5. When lifting the load at constant speed, the electric motor 6 therefore needs only deliver that energy corresponding to the difference in weights between load 1 and counterweight 4. This difference cannot be entirely made zero, in order to obtain a stable condition for the system and so the load can descend under its own weight.

Even through in this case the load 1 is of constant weight, there are three states of different accelerations in the system,

- a state of positive acceleration at the beginning of the upward motion and at the end of the downward motion;
- a state of zero acceleration during most of the upward and downward motion;
- a state of deceleration at the end of the upward motion and the beginning of the downward motion.

Upward accelerations are considered positive and downward accelerations negative.

If the system is assumed conservative, the sum of the kinetic and potential energies being constant, it can be shown that the external force which must be exerted on the cable 2 (and therefore also the torque of motor 6) changes linearly with the acceleration f load 1. This force depends on the mass to be accelerated of load 1 and on that of the counterweight 4, also on the moments of inertia of the rotating parts, in particular on winch 5 and pulley 2. The linear relation is given as follows:

$$M=r_1R[2W/g-\Delta W/g+I_p/r_3{}^2+I_c/R^2]b/r_2+4_1R/r_2\Delta W$$

where

Figure 2A:
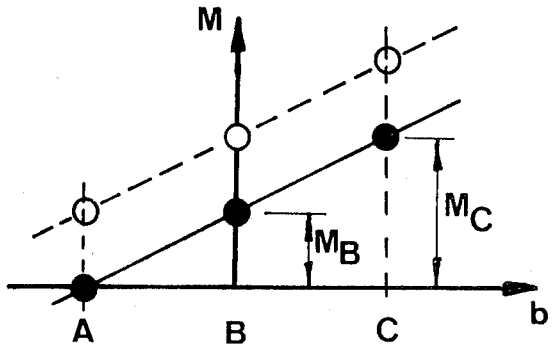
FIG. 2 shows graphs explaining the phenomena arising in counterweight systems.

M = torque of motor 6
b = acceleration of load 1 and counterweight 4
$r_1$ = radius of motor pinion 7
$r_2$ = radius of gear 8
R = winding radius of pulley 5
$r_3$ = radius of pulley 3
W = weight of load 1
$\Delta W$ = weight difference between load 1 and counterweight 4
$I_c$ = moment of inertia of the winch system
$I_p$ = moment of inertia of the pulley system When suitably choosing the weight of counterweight 4, the torque of motor 6 in the optimal case can be made zero for one of these acceleration states. This is shown in FIG. 2a. The dashed line shows the torque M which motor 6 must deliver as a function of the acceleration b of load according to the above equation, points A. B. C corresponding respectively to constant deceleration, acceleration zero and constant positive acceleration. The solid line shows the optimal solution that can be achieved with a constant counterweight; this solution results when the torque M is precisely made null at the point A corresponding to deceleration, that is, when the motor at the begining of the lifting phase or at the end of the descent phase is not required to deliver any torque. But it is see from FIG. 2a that in such a case the motor 6 must deliver a torque during the other acceleration phases, namely during the phase B of constant speed—which exists during most of the upward and downward motion, denoted as torque $M_B$, and during the C phase of positive acceleration at the beginning of the upward motion and at the end of the downward motion, denoted as torque $M_C$. The energy corresponding to these torques must be supplied externally to the load 1 during the upward motion; it might be recovered in part during the downward motion, provided motor 6 then were to operate as a generator. This solution however being impractical in most cases, the potential energy stored during the upward motion usually is lost during the downward motion due to braking.

Figure 2B:
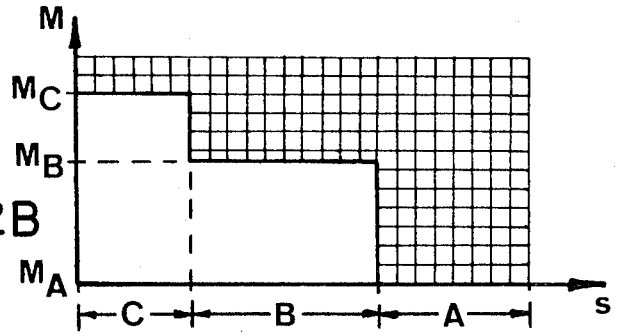

FIG. 2b shows torque M as a function of path s of load 1, in solid lines, for the optimal case of FIG. 2a. This diagram indicates the limits of optimization that can be achieved using a constant counterweight.

Figure 2C:
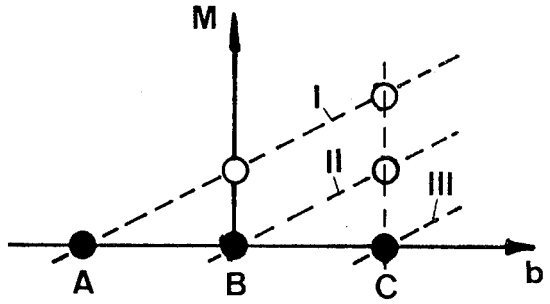

The essential concept of the invention is to so change the effective weight of counterweight 4 that a force-equilibrium exists in every phase of motion, whereby in the ideal case the the energy supplied externally can go to null. The result from this step is shown in the diagram of FIG. 2c, like that of FIG. 2a, shows the required torque as a function of acceleration b. Line 1 applies to the case of the counterweight 4 being such that during the A phase of deceleration no torque need be supplied. Ths corresponds to the case shown in a solid line in FIG. 2a. Line 11 corresponds to the case of counterweight 4 being such that during the B phase of zero acceleration (constant speed) no torque need be applied, and lastly line 111 applies to the case that during the C phase of positive acceleration, the torque applied also can be zero. Attention must be paid to the fact that the selection of counterweight 4 for phase C of positive acceleration according to line 11 still would require a positive torque for phase C of positive acceleration, but would also result in a negative torque for the A phase of deceleration. In fact, in our example case, the latter case would be impossible as no negative force can be transmitted by the cable. Similarly the selection per curve 111 of the counterweight would require negative torques for phases A and B, which cannot be transmitted by a cable. On the other hand, a negative torque might be delivered if the connection between the source of energy (drive motor 6) and the load were rigid in nature.

FIG. 2a shows that optimization regarding the torque to be delivered for all operational states can be achieved only if the mass (and hence weight) of counterweight 4 varies in such manner during system operation as to be adapted to the particular acceleration. If that is done, the torque which must be delivered to the three acceleration stages A, B and C can be extensively decreased and ideally made to vanish, as indicated by the three black dots on the abscissa of FIG. 2c.

FIG. 3 shows schematically a system of the kind shown in FIG. 1 in the various operational states, comprising a load 1 suspended from a cable 2, a winch 5 and a pulley 3. However counterweight 4 is divided into three partial weights 4a, 4b and 4c in this case, and the lowermost, 4a, is fastened to cable 2, while the other two partial weights 4b and 4c are resting on cable 2 in a manner allowing them to slide freely, whereby normally they rest on the lowermost partial weight 4a, unless held at a definite place in their path of motion by holding means not shown.

FIG. 3 furthermore indicates three zones of different accelerations along the path of load 1, namely zone A of negative acceleration at the end of the upward motion and at the beginning of the downward motion, middle zone B of zero acceleration and the lower zone C of positive acceleration at the beginning of the upward motion and the end of the downward motion. The counterweight 4 passes through the corresponding zones in the opposite direction.

Figures 3A, 3B, 3C, 3D, 3E, 3F:
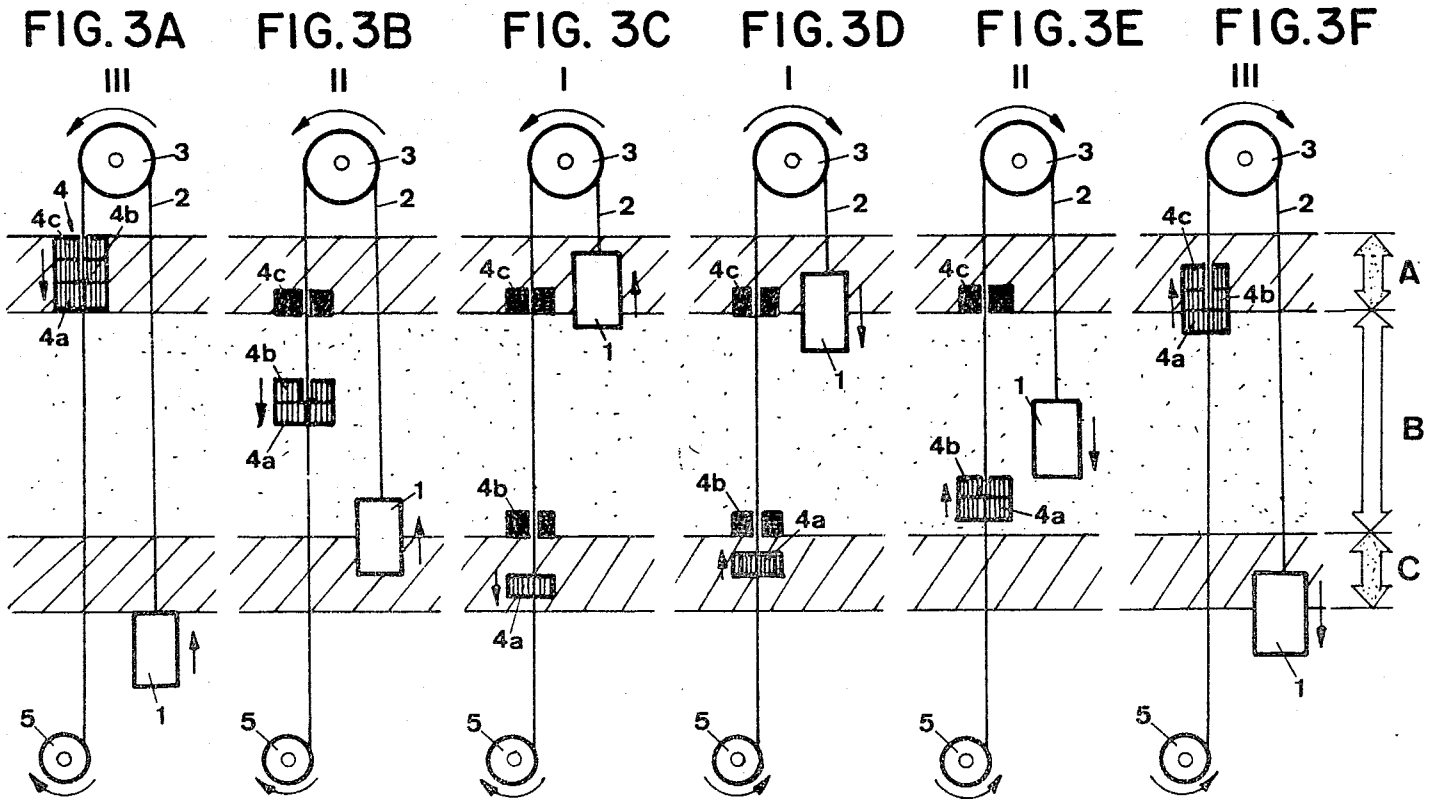
FIG. 3 shows schematics of a counterweight system of the invention in various operational stages, for the purpose of explaining the basic principle of the invention.

FIG. 3*a* shows the beginning of the upward motion of load 1 through the zone C of positive acceleration. The two free movable partial weights **4*b* and 4*c* of the counterweight rest on partial weight 4*a* which is solidly connected to the cable 2, so that the effective counterweight is the sum of the partial weights. This sum is so selected that the torque to be delivered, taking into account the positive acceleration, has precisely the value null; This corresponds to the state shown by curve 111** of FIG. 2*c*. Load 1 therefore is essentially accelerated through zone C by the effective counterweight without the drive motor being required to deliver a torque.

The moment load 1 leaves zone C and enters zone B of constant speed, the uppermost partial weight **4*c* is retained by holding means not shown, whereby only the two partial weights 4*a* and 4*b*** act as effective counterweight (FIG. 3*b*). These two partial weights are so selected that the torque to be delivered at constant speed essentially is null, as indicated by curve 11 in FIG. 2*c*; practically this means that the sum of the partial weights **4*a* and 4*b* essentially equals that of load 1. Hence the lifting of load 1** at constant speed takes place in zone B, without the drive motor being required to deliver an appreciable torque.

When at last load 1 enters zone A of deceleration, partial weight **4*b*** too is retained by holding means not shown (FIG. 3*c*), so that only the partial weight **4*a* remains effective as counterweight. The partial weight 4*a* is so selected that, taking the deceleration into account, the drive motor is required to deliver a torque essentially zero, as indicated by curve 1** of FIG. 2*c*.

Because the static and dynamic forces arising in the above described system are a precisely known function of the path of the load, and as they are periodically identical, it is possible to wholly adapt the effective counterweight to the particular static and dynamic forces exerted by the load. If the described system were conservative, the processes described practically would require no external energy. In an actual system however friction is generated, which must be overcome by energy from the drive motor. Such frictional energy however is small compared to that needed to accelerate and raise the load. While such energy is converted into potential or kinetic energy, it is lost in most systems because it cannot be recovered, or if so only in part. In the described system however, in view of the adaptation of the counterweight to the various operational states, the potential and kinetic energies are recovered within the system, whereby the supply of external energy essentially is restricted to the friction-induced losses.

Figure 4:
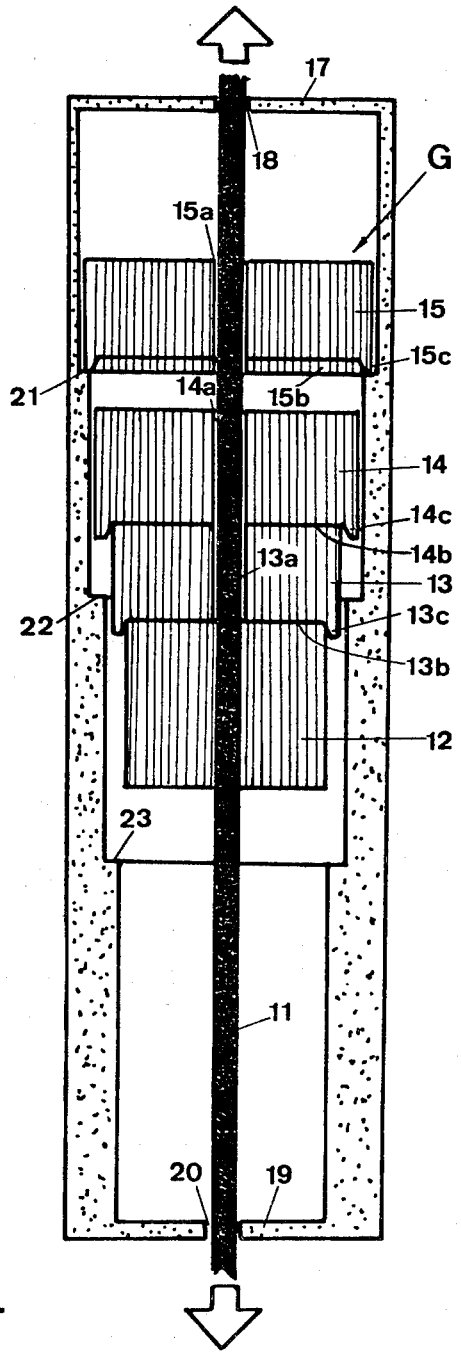
FIG. 4 is an embodiment of a counterweight system of the invention, resulting in the functioning explained in relation to FIG. 3.

FIG. 4 shows a practical embodiment of a counterweight system by means of which the operation explained in FIG. 3 is obtained. It is assumed again in illustrative manner that the counterweight shall act on a cable 11 used for instance to raise a load by means of a pulley. The counterweight in its totality is denoted by G and in this case consists of four partial weights 12, 13, 14, 15 of which the lowermost, 12, is solidly connected to the cable 11, whereas the partial weights 13, 14, 15 comprise central apertures **13*a*, 14*a* and 15*a* respectively with a diameter somewhat larger than that of cable 11, and passing said cable, whereby these partial weights can slide along it. Where appropriate, anti-friction sleeves may be inserted into these central apertures. The partial weights may be of any desired cross-section, for instance circular or square. In any event, however, the cross-sectional size in the plane of the drawing of FIG. 4 shall be different for each partial weight, namely it increases from the lowermost partial weight 12 to the uppermost one 15. If the partial weights for instance are circular, then partial weight's 12 diameter is the smallest, each of the ones above being larger in diameter than the one below. Each partial weight 13, 14, 15 therefore protrudes sideways beyond the particular partial weight 12, 13, 14 respectively below it. Furthermore each of the three upper partial weights 13, 14, 15 comprises at its lower surface a flat recess 13*b*, 14*b* and 15*b* respectively to seat the smaller partial weight below it if desired, and which is surrounded by a downward projecting collar 13*c*, 14*c* and 15*c*** respectively.

The partial weights 12, 13, 14, 15 are mounted in a guideway 16 surrounding the partial weights like a duct. Guideway 16 is closed at the top by an upper wall 17 comprising a central aperture 18 to pass the cable 11; the guideway 16 is closed at the lower end by a lower wall 19 with an aperture 20 again to pass cable 11.

The cross-sectional shape of the guideway 16 is adapted to that of the partial weights, that is, it will be circular if the partial weights are. The wall of guideway 16 comprises stepped shoulders 21, 22, 23 on the inside which divide it into sections of different cross-sections each so adapted to that of a particular partial weight that same can freely move within it. Thus the uppermost partial weight 15 is free to move within the section above shoulder 21, but it cannot move beyond it downward because this shoulder protrudes inward into the path of rim part **15*c* of partial weight 15. The partial weight 14 correspondingly can move as far down as shoulder 22 which in turn protrudes inward into the path of the rim part 14*c*, and partial weight 13 can move down as far as shoulder 23, lastly partial weight 12 can move as far down as lower wall 19**.

It is at once clear how the counterweight system shown in FIG. 4 operates. The upper partial weights 13, 14, 15 all rest on the lowermost partial weight 12 which is solidly connected to cable 11 when the counterweight G is in the highest position, so that this cable 11 is acted on by the sum of all of the partial weights of counterweight G. The upper partial weight 15 may make contact with the upper wall 17.

When the counterweight G moves down, the partial weights at first all move together, the uppermost partial weight 15 being guided by the wall of guideway 16 while the other and lower partial weights 12, 13, 14 are guided by the cable 11 and also by their seating in the flat recess **15*b*, 14*b* or 13*b*** respectively of the particular partial weight above. In this first section of the downward motion the entire weight of counterweight G remains effective.

When partial weight 15 hits shoulder 21, latter catches and holds it, so that it is lifted off partial weight 14 and no longer participates in the further downward motion. Now cable 11 is acted on only by the sum of the partial weights 12, 13, 14. When partial weight 14 hits shoulder 22, it too is retained, and only the sum of partial weights 12 and 13 remains effective in the next section of the down motion. In the last section, only partial weight 12 remains effective because of partial weight 13 being retained by shoulder 23. Partial weight 12 then can move alone downward until finally it hits the lower wall 19.

These processes are repeated in the reverse order in the upward motion: only the partial weight 12 is effective along the first segment of the upward motion until it hits partial weight 13 resting on shoulder 13. It then carries along partial weight 13 so that in the ensuing segment of the upward motion the two partial weights 12 and 13 are effective together. Similarly partial weights 14 and 15 are carried along, so that again the sum of all partial weights is effective, in the last part of the upward motion, on cable 11. The counterweight system shown in FIG. 4 therefore provides the operation described in FIG. 3.

FIG. 4 illustrates the versatility and adaptability of the described counterweight system. On one hand there is no restriction on the number of partial weights into which the counterweight G may be subdivided. Agai the partial weights can be of different magnitudes, and the distances over which the individual partial weights are effective can be arbitrary. This allows adapting the variation of the effective weights of partial weights G to very different behaviors of the static and dynamic forces of the load. The course of counterweight G and hence that of the load (not shown), depends on the length of the guideway 16, which can be made arbitrarily large.

Figure 5:
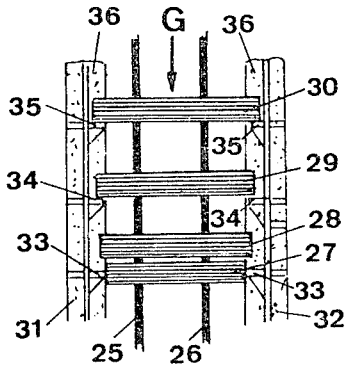
FIG. 5 is another embodiment of the counterweight system of the invention.

There is no need for the guideway to surround like a duct, as shown in FIG. 4, the counterweight on all sides; depending on the shape of the partial weights and the available space, it suffices the guideway be present at two opposite locations of the partial weights. This is the case for the embodiment shown in FIG. 5 and 6. FIG. 5 shows in schematic side view a counterweight system with a counterweight G for two parallel cables 25, 26 connected to a load (not shown). The counterweight G consists of four partial weights 27, 28, 29, 30 which in this case assume the shape of long parallelipipedic blocks of the same cross-section but different length, the length of the partial weights increasing from the lowermost 27 to the uppermost 30, whereby each of the upper partial weights 28, 29, 30 projects somewhat on both sides beyond the particular partial weight below 27, 28, 29. The lowermost partial weight 27 is connected to both cables 25 and 26, while the three upper partial weights comprise passages through which the cables 25 and 26 can slide.

Figure 6:
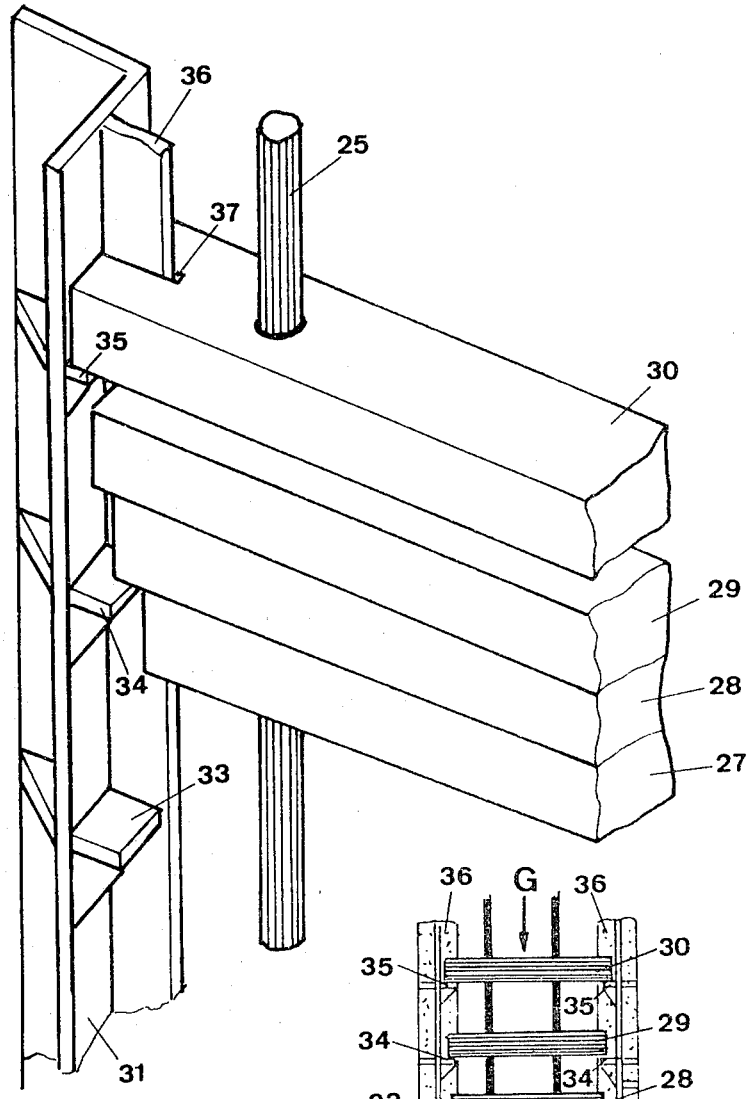
FIG. 6 is an enlarged perspective partial view of the counterweight system of FIG. 5.

In this instance the guideway consists of two vertical supports 31 and 32 each made of an angular section (FIG. 6). Each support 31, 32 is provided on its side facing the partial weights with projections 33, 34 or 35, which project inward with different lengths, so that the spacing between the projections 33 is somewhat larger than the length of partial weight 28 but somewhat smaller than the length of partial weight 29, the spacing between projections 34 exceeding the length of partial weight 28 somewhat but being somewhat smaller than the length of partial weight 29, and lastly the spacing between projections 35 slightly exceeding the length of partial weight 29 but being slightly smaller than the length of partial weight 30.

To achieve satisfactory guidance of the partial weights in this embodiment too, an inwardly projecting vertical guidance strip 35 furthermore is mounted to each support 31, 32, and each partial weight comprises a side guidance slot penetrated by said strip 36. FIG. 6 shows the guidance slot 37 of the uppermost partial weight 30.

The embodiment of FIG. 5 and 6 operates just the same as that of FIG. 4, so that repetition of this description is superfluous.

Figure 7A:
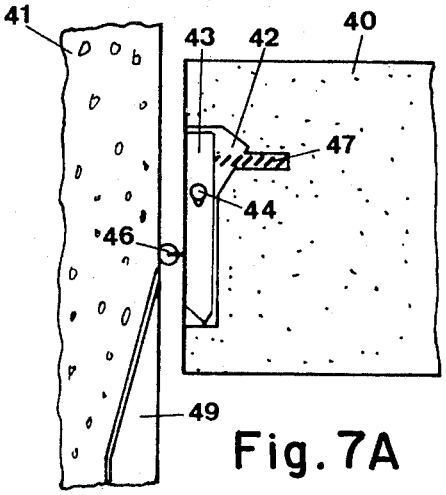
FIG. 7 is a schematic partial elevation of a partial weight and of a section of the guidance path in another embodiment of the counterweight system of the invention in three different operational positions.
Figure 8:
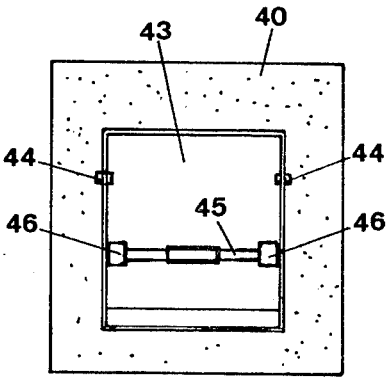
FIG. 8 is the front view ofthe partial weight of FIG. 7.
Figure 7B:
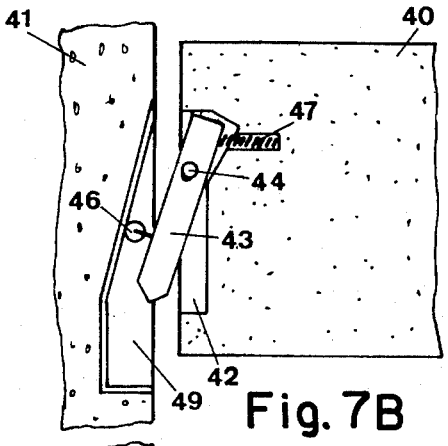
Figure 7C:
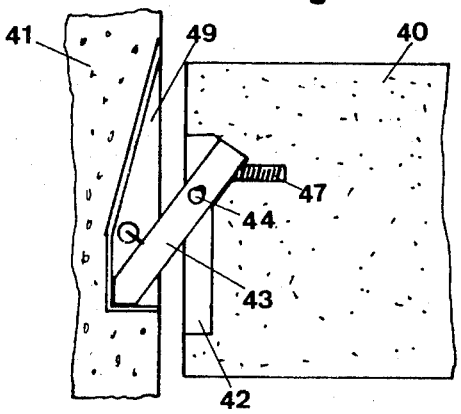
Figure 9:
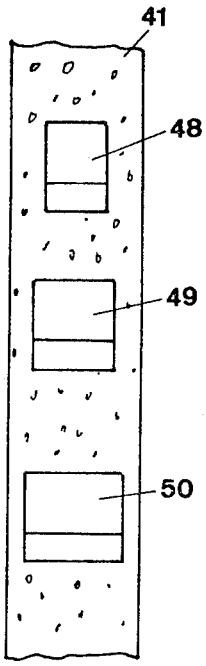
FIG. 9 is the front view of a larger section of the guideway of FIG. 7.

FIG. 7, 8, 9 show details of an embodiment of a counterweight system, in which the partial weights move between two vertical guidances as in FIG. 5 and 6, but where all the partial weights are of the same length and the guidances lack stepped projections. FIG. 7 shows a segment of a partial weight 40 and a segment of a guidance means 41 in three different positions; FIG. 8 is a front fiew of partial weight 40 and FIG. 9 shows a larger cut-out of guidance means 41, in front view, and on a smaller scale.

Partial weight 40 comprises a flat recess 42 in its end face pointing toward the guide means 41, said recess housing a sturdy plate 43 which can be pivoted to the outside by means of the pivot-bearings 44 on which it is supported. A horizontal shaft 45 rests on the outside of plate 43 and extends across the entire width of ths plate (FIG. 8), holding a roller 46 at each end. The dimensions of rollers 46 are such that they rest against the surface of guide means 41 facing the partial weight. A tension spring 47 biases plate 43 toward outside pivoting, but this bias ordinarily (FIG. 7*a*) is prevented by rollers 46 resting against guidance means 41. Obviously there is also the same arrangement with a pivotable plate at the end face of the partial weight opposite the second guide means. Guide means 41 is provided with contracting pockets 48, 49, 50 (FIG. 9) of varying widths, each pocket being somewhat wider than the one above it. The width of the pivoting plates of each partial weight is so adapted to the width of one of the pockets of the guidance means as to be capable of entering said pocket while not fitting into any of the higher pockets. The widths of the plates therefore too are different in the partial weights. It is assumed in FIGS. 7, 8, 9 that the pocket 49 is associated with partial weight 40. Accordingly, as partial weight 40 moves downward, the rollers 46 first pass the two sides of the smaller pocket 48, so that the plate 43 cannot be pivoted outward. When however the partial weight 40 arrives at pocket 49, rollers 46 can enter the pocket, whereby the tension spring 47 can swing plate 43 to the outside. Plate 43 thereby wedges itself (FIG. 7*c*) between the bottom of pocket 49 and the correspondingly shaped upper side of recess 42, so that the partial weight 40 is retained in place at the height of pocket 49.

Because of the different widths of pockets 48, 49, 50 and the correspondingly adapted widths of plates 43, the various partial weights can be retained at different heights of the guidance path 41 and accordingly be separated from the counterweight.

Figure 10:
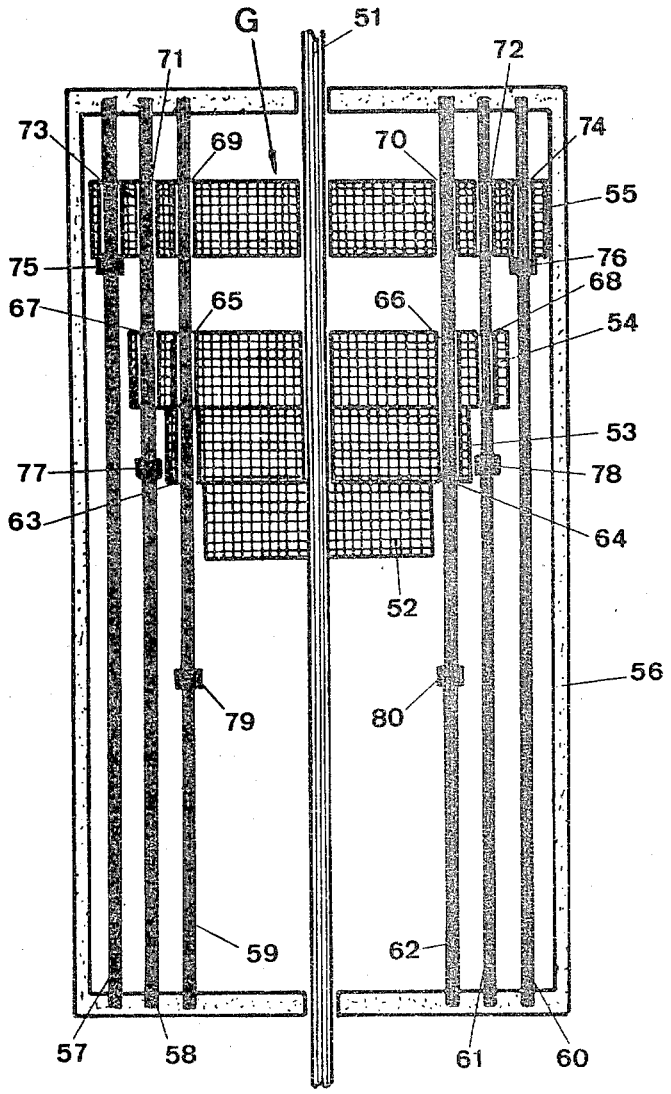
FIG. 10 is another embodiment of the counterweight system of the invention.

FIG. 10 shows an embodiment in which the counterweight G cooperating with a cable 51—similarly to the embodiment of FIG. 4—consists of four partial weights 52, 53, 54, 55 housed in a shaft-like housing 56. The lowermost partial weight 52 again is connected to the cable 51, while the upper partial weights 53, 54, 55 comprise passage for cable 51. Again the partial weights differ in their cross-sectional dimensions, so that every upper partial weight 53, 54, 55 projects sideways over the particular partial weight below it, namely 52, 53, 54.

Three vertical guide posts 57, 58, 59 and 60, 61, 62 respectively are mounted on each side of cable 51 in housing 56, and extend over the entire height of said housing. The distance between the innermost guidance posts 59 and 62 is larger than the transverse dimension of the lowermost partial weight 52, so that this partial weight can freely move over the entire height of housing 56 between the guide posts. Partial weight 53 comprises vertical guide slots 63, 64 on both sides projecting beyond the partial weight 52, being slidingly supported by means of said slots on the guide posts 59 and 62. The partial weight 54 is provided with two guide slots 65 and 66, which are colinear with the guide slots 63 and 64 respectively of partial weight 53 and which also glide along guide posts 59 and 62. Partial weight 54 furthermore is provided at the segments projecting outward beyond the partial weight 53 with two further guide slots 67, 68 through which the center posts 58, 61 respectively pass in gliding manner. Lastly partial weight 55 comprises six guide slots 69, 70, 71, 72, 73, 74, the first two of which, namely 69 and 70, housing the center guide posts 59 and 62 respectively, the center guide slots 71 and 72 housing the center guide posts 58 and 61 respectively, and lastly the outermost guide slots 73 and 74 housing the outermost guide posts 57 and 60 respectively.

Stop pieces 75, 76 are mounted at the same height on the two outer guide posts 57 and 60. The center guide posts 58 and 61 are equipped with enlarged stops 77, 78 also at the same height but lower than stops 75, 76. Lastly stops 79, 80 are mounted again at the same height but still lower on the inner guide posts 59 and 62.

The functioning of this counterweight system can be immediately seen. When the counterweight G assumes its uppermost position, where partial weight 55 hits the upper wall of housing 56, all partial weights rest on the lowermost 52 which is connected to cable 51, whereby the sum of all the partial weights is effective as counterweight. When moving down and following a certain distance, the upper partial weight 55 is caught by stops 75, 76 of the outer guide posts 57, 60 and thereby separated from the counterweight. The same process is repeated for partial weight 54, when this one hits stops 77, 78 and for partial weight 53 when hitting stops 79, 80, so that below this stop 79, 80 only the lowermost partial weight 52 remains effective as counterweight. When the motion takes place upward, the lowermost partial weight 52 sequentially carries along the upper partial weights 53, 54, 55.

The vertical guide posts of this embodiment provide an especially reliable and accurate guidance of the individual partial weights.

Figure 11:
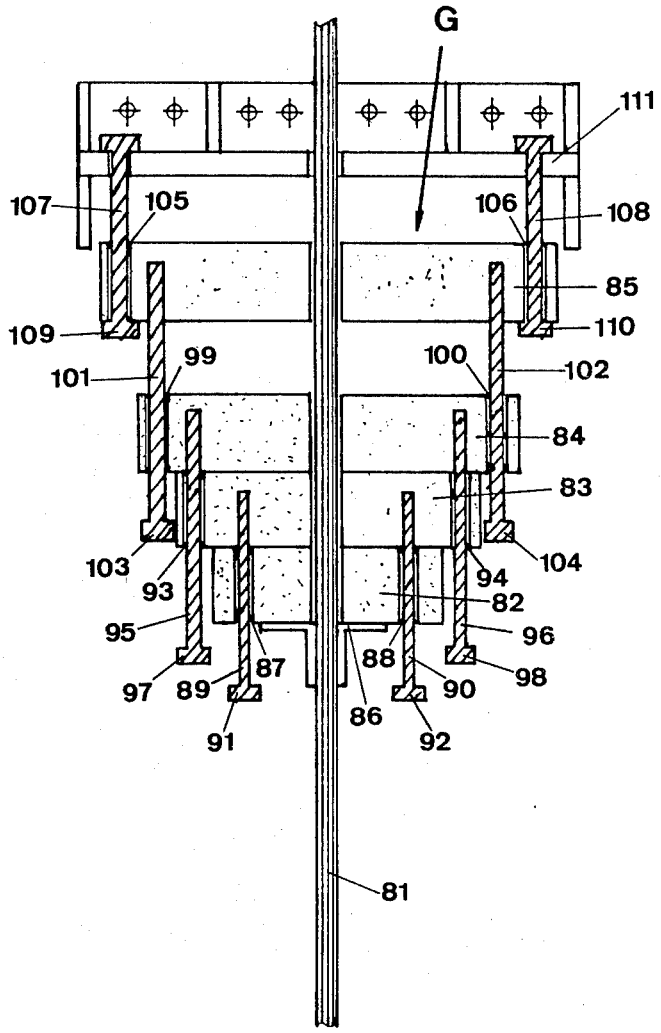
FIG. 11 is an embodiment of the counterweight system without guideway.

FIG. 11 shows an embodiment of a counterweight requiring no special guideway with fixed stops to catch the partial weights. The counterweight G acting on a cable 81 again consists of four partial weights 82, 83, 84, 85 which in this instance all are provided with central apertures through which slides the cable 81. The lowermost partial weight 82 rests on a support 86 solidly fastened to cable 81. The transverse dimensions of the partial weights increase from the lowermost 82 to the uppermost 85, so that each partial weight 83, 84, 85 projects on both sides beyond the one below it, 82, 83 and 84 respectively. The lowermost partial weight 82 comprises two vertical guide slots 87, 88 on both sides of the central aperture through which are passing in sliding manner the vertical guide bars 89 and 90 respectively which are fastened by their upper ends to the partial weight 83 and are provided at their lower free end with a widened stop 91 and 92 respectively. Partial weight 83 comprises corresponding guide slots 93, 94 in both segments projecting sideways beyond partial weight 82.

Guide bars 95, 96 pass in sliding manner through these guide apertures and are fastened at the upper ends in partial weight 84 while holding widened stops 97, 98 respectively at the lower ends. Correspondingly partial weight 84 is provided with guide apertures 99, 100 in the sideways projecting segments, through which pass the vertical guide bars 101, 102, which are fastened by their upper ends in partial weight 85 and at their lower ends hold widened stops 103, 104 respectively. Partial weight 85 comprises guide apertures 105, 106 in the sideways projecting segments, through which pass the vertical guide bars 107, 108 in sliding manner, which also are provided with widened stops 109, 110 at their lower ends. The upper ends of guide bars 107, 108 are mounted to a fixed support 111.

When, in this embodiment, the counterweight G assumes its uppermost position, all the partial weights rest one upon the other and on stop 86, the uppermost partial weight 85 touching the fixed support 111. When the counterweight G moves downward, first all the partial weights move down together, so that the sum of all these partial weights acts as counterweight on cable 81.

During this common descent, the partial weight 85 with its guide apertures 105, 106 slides along the guide bars 107, 108 held by the support 111. This common motion continues until the partial weight 85 hits the stops 109, 110 of guide bars 107, 108. It will then be held by these and can no longer participate in any further descent. Thereafter the partial weight 84 with its guide apertures 99, 109 slides along the guide bars 101, 102 which are held together with partial weight 85; this corresponds to the condition shown in FIG. 11. The counterweight now is only the sum of the three partial weights 82, 83, 84 on cable 81. When furthermore the partial weight 84 hits the support 103, 104 of its guide bars 101, 102, it too is retained henceforth and next only the partial weights 82, 83 may descend in common. After partial weight 83 is retained by stops 97, 98, there remains only the lowermost partial weight 82 as the counterweight, until it too at last hits stops 91, 92.

During the upward motion, support 86 sequentially carries along the various partial weights, so that the effective counterweight increases stepwise.

Figure 12:
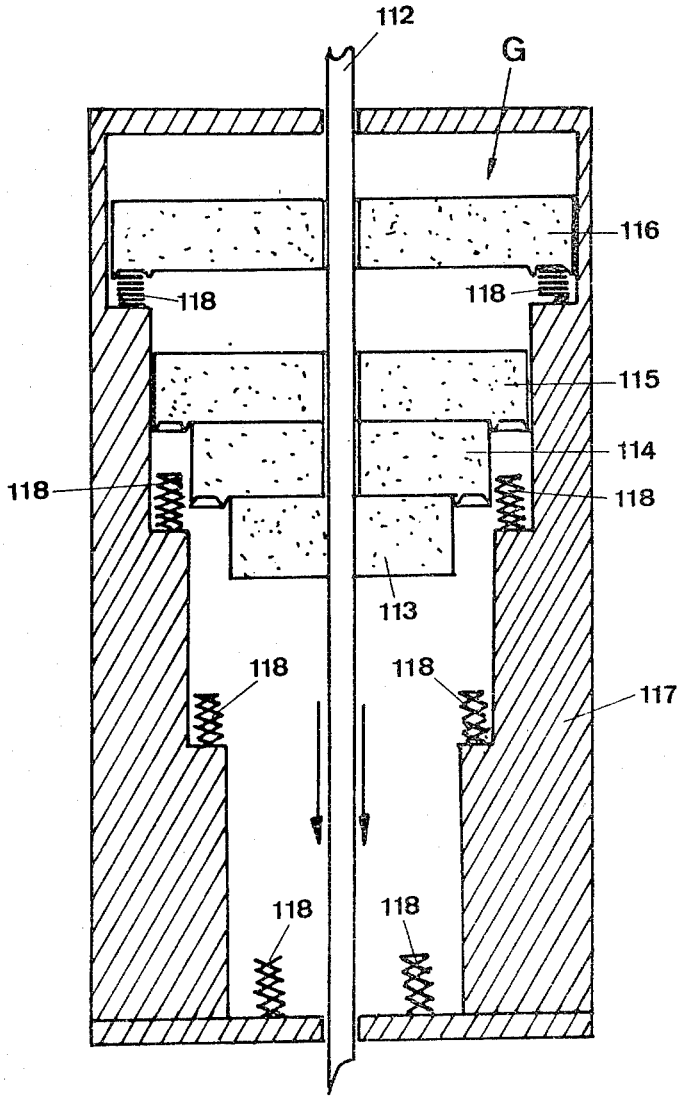
FIG. 12 is a counterweight system of the kind shown in FIG. 4 with additional shock absorbers.

In the embodiments considered so far, dynamic impacts that may occur during rapid motions of the partial weights were neglected. No special measures need be taken to absorb such dynamic impacts when the speed of the partial weights is sufficiently low. At higher speeds however it may be necessary to absorb or cancel the dynamic impacts. This can be done by using conventional elastic or energy-absorbing shock absorbers mounted between the partial weights and the stops that are meant to retain them. This is illustratively shown in FIG. 12 for a counterweight system of the kind represented in FIG. 4. The counterweight G connected to cable 112 consists of four partial weights 113, 114, 115, 116 which similarly to the embodiment of FIG. 4 are mounted inside a guideway 117 with stepped inside wall. Springs 118 are indicated as the shock-absorbing means. They rest on the shoulders or on the lower wall of guideway 117. As shown for the uppermost partial weight 116, these springs are compressed when being hit by the partial weight, whereby the kinetic energy of the partial weight 116 is stored and the partial weight is elastically retained. Other shock-absorbing means in lieu of springs may also be used in known manner. Corresponding shock-absorbing means also may be mounted between the surfaces in contact or coming into contact between adjacent partial weights.

Figure 13A:
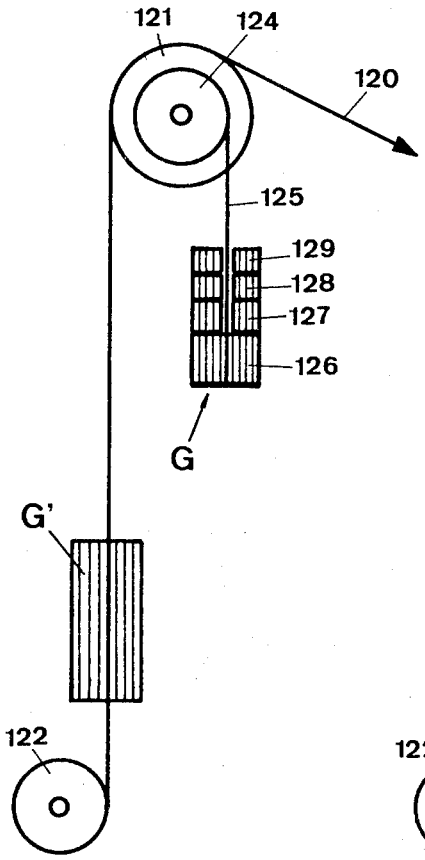
FIG. 13 is a counterweight system of the invention with two oppositely acting counterweights.
Figure 13B:
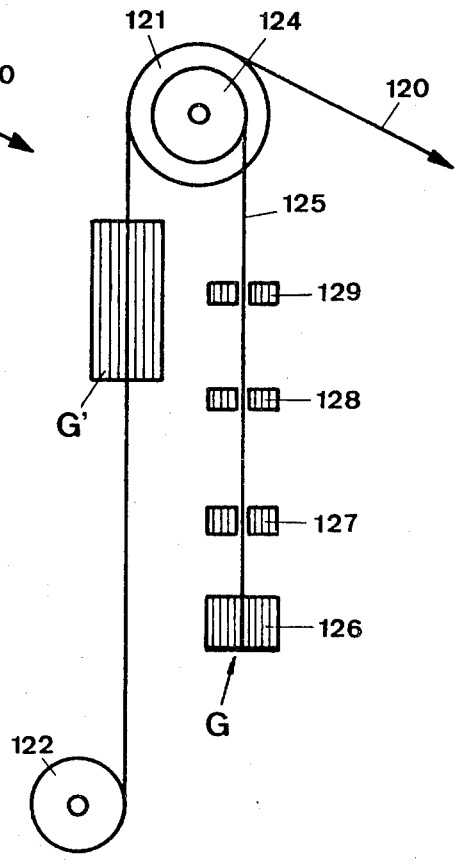

All the embodiments so far share the property that the effective weight of the counterweight is progressively decreased during descent and progressively increased during the upward motion. By superposing the effects from two or more counterweights it is possible also to achieve other variations of the counterweight as function of its displacement. FIG. 13 schematically shows an embodiment of the counterweight system employing such a principle. Therefore in this case the effective weight of the counterweight as sensed by the load progressively increases during counterweight descent and decreases progressively as it rises.

FIG. 13 shows a cable 120 connected with a load (omitted) and passing over a pulley 121 to a motor-driven winch 122. A fixed counterweight G' is fastened to the segment of the cable 120 which lies between the pulley 121 and winch 122. A second winch 124 is rotationally ganged to the shaft of pulley 121, and a variable counterweight G is suspended from the cable 125 of said winch 124. Winches 122 and 124 are so mounted that the counterweight G descends when counterweight G' rises, and vice-versa. It is clear at once that the two counterweights G and G' act in opposite directions as regards the load, so that the entire counterweight effective with regard to the load equals the difference between the weight of counterweight G' and the effective weight of counterweight G.

The counterweight G consists of four partial weights 126, 127, 128, 129 and assumes the design of any of the embodiments described above, whereby the partial weights are sequentially caught during its descent and the effective weight of counterweight G when in the lowermost position (FIG. 13*b*) is determined by the lowest partial weight 126 alone, whereas in the highest position (FIG. 13*a*), the effective weight of counterweight G equals the sum of all partial weights 126, 127, 128, 129.

The operation of the counterweight system can be immediately known from the representation. When the fixed counterweight G' assumes its lowest position (FIG. 13*a*), the counterweight effective for load 120 is of its smallest value, as it corresponds to the weight of counterweight G' less the sum of the four partial weights 126, 127, 128, 129. When the fixed counterweight G' moves up, whereby counterweight G will descend, the uppermost partial weight 129 shall be caught at a given location of its path, so that only the three partial weights 126, 127 and 128 remain effective for counterweight G. The counterweight effective for the load therefore is increased by the amount of the partial weight 129. During the further descent of the counterweight G, partial weights 128 and 127 too are sequentially caught, whereby the counterweight effective with respect to the load is increased each time by the amount of those partial weights. The reverse process takes place during the ascent of the variable counterweight G, namely during the descent of the fixed counterweight G'.

FIG. 13 shows the simplest case of such superposition of the effects of several counterweights. This principle however is versatile and adaptable. For instance significantly complex changes of the effective counterweight as a function of the path may be achieved by making the two oppositely acting counterweights variable; this might be achieved in the embodiment of FIG. 13 by also subdividing the counterweight G' into several partial weights which are eliminated sequentially in the previously described manner. It is possible in such a case for instance to obtain a decreasing counterweight over part of the course in a given direction of motion and again in the same direction for the remainder of the course a counterweight increasing once more. As on the other hand the dimensions of the various partial weights and the locations where they are made effective or ineffective are selective at will, adaptation to arbitrary load curves can be achieved.

For the application illustrated in relation to FIG. 1 through 3, where the load is raised vertically and lowered also vertically, the static force exerted by the load remains constant over its entire path; the variations in the counterweight serve only to compensate the varying dynamic forces of acceleration. However the described counterweight system is just as applicable to those cases in which the static force exerted by the load varies, whereby there is superposition of the changes in static and dynamic forces.

Figure 14:
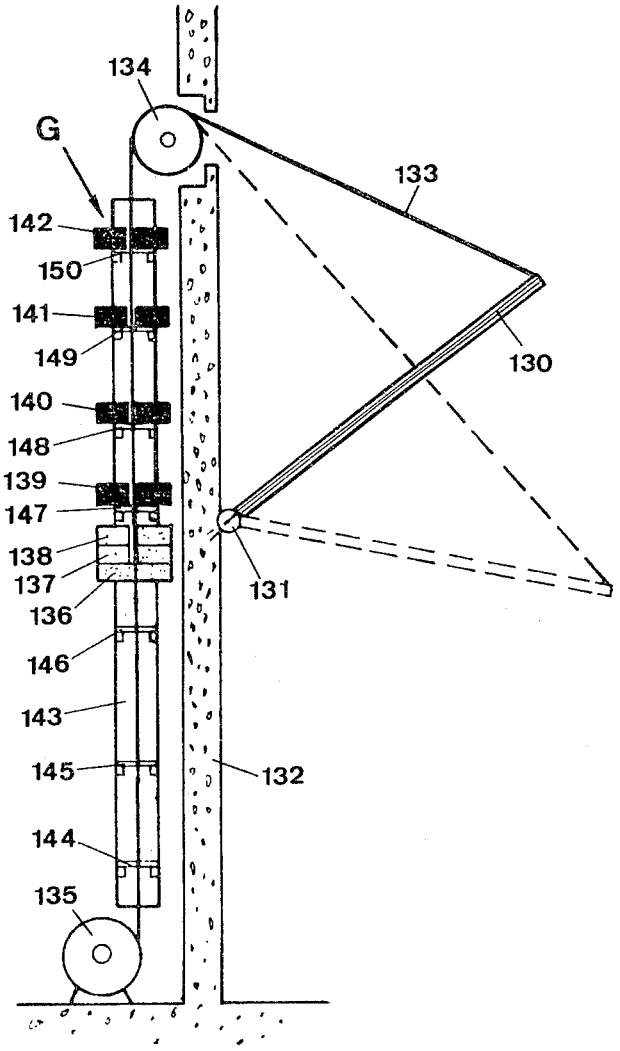
FIG. 14 is a counterweight system in which load and counterweight are rigidly connected, shown in two different operational positions.

An example to that end is given by FIG. 14. In this case the load is formed by a pivoting member 130 which is pivotably held at one side by means of a hinge 131 in a vertical wall 132, while a cable 133 acts on the opposite end of said member, said cable being capable of rotating both the pivoting member 130 and the hinge 131. Rotating member 130 may be a plate, for instance drop door or a sealing cover; the pivoting member 130 also may be like a beam, for instance a drawbridge.

Cable 133 passes over a pulley 134 to a motor-driven winch 135 by means of which the pivoting member 130 can be pulled up; for the opposite direction of rotation of the winch 135, the pivoting member 130 descends under its own weight.

It can be immediately seen that the static tension exerted by cable 133 on pivoting member 130 varies with the angular position of said member. The dynamic forces now superpose on those changing static forces, where said dynamic forces arise from the positive and negative accelerations at the beginning and end of the ascent and descent of pivoting member 130. Unlike the case of the example of FIG. 1, for which there are only three ranges with different forces, in this instance there is also the factor of the tension exerted by cable 133 varying during the entire pivotal motion of the pivoting member 130.

While no constantly varying counterweight can be achieved to precisely compensate the constantly varying tension of cable 133 at every point when using the above described counterweight system in which the counterweight is subdivided into several partial weights, it is nevertheless possible by resorting to a sufficient fine subdivision of the counterweight to obtain a very good if stepped adaptation of the counterweight to the constantly changing load. For example, this is achieved in the embodiment of FIG. 14 in that a variable counterweight G is mounted within the cable segment between pulley 134 and winch 135, which is subdivided into seven partial weights 136, 137, 138, 139, 140, 141, 142. For illustration it is assumed that the counterweight system coresponds to the embodiment of FIG. 5 and 6. Vertical supports, of which 143 is shown in FIG. 14, are mounted on both sides of the partial weights. Stepped rests 144, 145, 146, 147, 148, 149, 150 are mounted to these supports, which increasingly project more from top to bottom into the path of the partial weights and accordingly retain the variously wide partial weights at various locations of their paths, as was explained in relation to FIG. 5 and 6. It is assumed in FIG. 14 that for half completed ascent of pivoting member 130, the upper four partial weights 142, 141, 140, 139 are retained by their associated rests 150, 149, 148, 147, whereby the effective weight of the counterweight remains only that formed by the three lower partial weights 136, 137, 138. During the further ascent of pivoting member 130, the remaining partial weights too are retained by their associated rests 146, 145, 144, so that the effective weight of the counterweight is progressively diminished. By suitably selecting the partial weights and the locations at which their retaining rests are mounted, the variation of the weight of the counterweight G may well adapt to the variations in static and dynamic forces acting on cable 133. The motor driving winch 135 then is required basically to deliver energy only to replace that lost by friction. Accordingly even very heavy pivoting members such as drawbridges and steel plates may be raised or lowered with little external energy input.

Figure 15A:
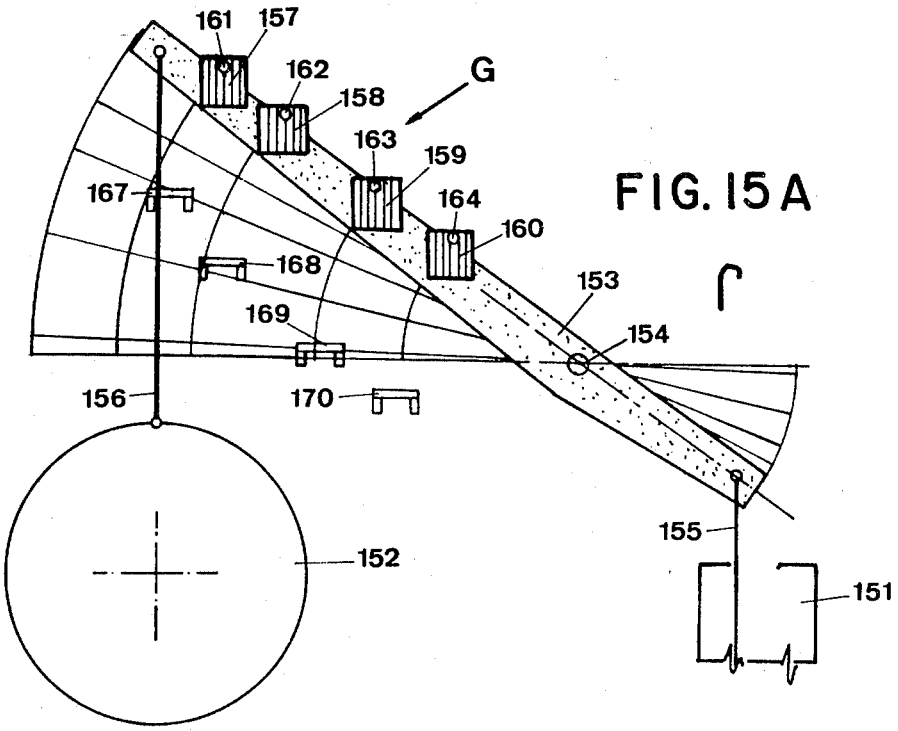
FIG. 15 shows the application of the counterweight system of the invention to load generating variable static forces.

The counterweight system described in no way is restricted only to applications in which counterweight and load are connected by a cable. FIG. 15 for instance shows an application for which the connecting member between a load 151, a drive system 152 and the variable counterweight G is a rigid beam 153, which as a two-arm lever is pivotably supported by a horizontal shaft 154.

The load 151 can be an arbitrary operational machine requiring a reciprocating input, for instance a pump as used in oil drilling. The load 151 is connected to one end of the beam 153 by a rigid connection rod 155 transmitting the reaction forces. The drive system 152 is illustrated by a motor-driven cam connected by means of a drive rod 156 to the other end of the beam 153. The cam rotation therefore is transformed by drive rod 156 into a to-and-fro pivotal motion of beam 153, whereby in turn connecting rod 155 is made to move up and down.

Figure 15B:
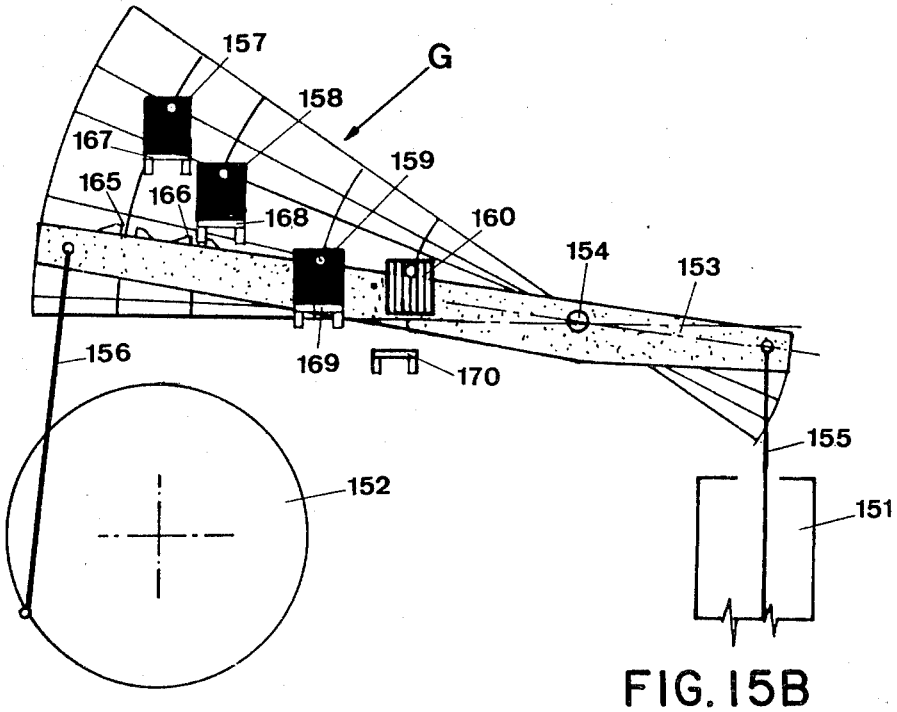

The counterweight G consists of four partial weights 157, 158, 159, 160 suspended at different locations of that arm of lever of the beam 153 which is connected to drive rod 156 in such manner that they can be lifted off. To that end each partial weight may consist of two halves mounted on both sides of the beam 153 and connected by a rod 161, 162, 163 and 164 respectively. Holding devices with upwardly open seating slots are provided at the top of the beam 153, which may seat rods 161, 162, 163 and 164 respectively. The holding devices 165, 166 associated with the two partial weights 157 and 158 are shown in FIG. 15*b*.

Therefore each partial weight moves along an arc of circle during the pivotal motion of beam 153, the center of said arc lying at the middle of shaft 154. A rest 167, 168, 169 and 170 is respectively mounted at a predetermined location of the arc-of-circle path of each partial weight. When the particular partial weight in its descent makes contact with the particular rest, latter retains it and thereby lifts it off its rest so it no longer takes part in the further pivotal motion of beam 153. In the opposite motion of beam 153, each partial weight is dragged along again by its associated holding device as latter reaches the height of the partial weight supported in the rest. The effective weight of counterweight G and hence the actual torque exerted by it on beam 153 therefore is decreased stepwise when the beam 153 pivots counterclockwise and stepwise increased when it pivots clockwise. FIG. 15 shows the positions of beam 153 where a change in counterweight occurs as radial lines. The change in torque is a function not only of the weight of each partial weight, but also its distance from the axis 154. By suitably selecting the number and the magnitudes of the partial weights, their distances from axis 154 and the positions of the rests retaining these partial weights, adaptation to any arbitrarily changing static and dynamic forces exerted by the load is possible, provided such variations be strictly periodic and are a known function of load displacement and hence of the beam 153.

As already explained several times, the described counterweight system with a variable counterweight allows an extensive reduction in the supply of external energy because the kinetic and potential energies arising within the movable system are largely recovered. Aside from any work delivered by the load, as in the case of the pump of FIG. 15, the externally supplied energy most of all can be restricted to the losses due to friction, air resistance, etc. However, because of certain tolerances, some of the kinetic and/or potential energy in the embodiments so far described is lost also, and this too must be replaced by external supply. For instance a complete balancing of the weights is impossible in all the systems in which counterweight and load are connected by a cable. For example, if the counterweight is resolved to permit load ascension without a requirement for external power, the load cannot descend under its own weight again. Furthermore such systems cannot be balanced in such manner that the load enters its final position precisely at speed zero. Any minor disturbance of the force or energy balance would either prevent the load from reaching this final position or result in kinetic energy still present at the final speed which would then be lost in braking (dissipated in friction and/or converted to system's potential energy). Lastly, depending upon the system, there can be certain forbidden operational states; for instance in the embodiment of FIG. 14, the pivoting member 130 may not be lifted as high as the vertical position or exceed it since it could no longer be made to descend. Therefore the previously described embodiments comprise an additional drive system, for instance a motor-driven winch which ensures the required conditions for satisfactory operation shall be met; because the counterweights are variable, however, such a drive system need only be of minor power capacity.

The embodiments of the counterweight described below make it possible to practically make full use of the kinetic and potential energies present in the system, so that, aside from making good frictional losses, this system is entirely autonomous. Such a system is particularly advantageous for the raising of heavy members, for instance steel or concrete plates or drawbridges which require moving only at long time-intervals, but thereupon as quickly as possible. It is undesirable to make use of and install drive equipment with relatively large power output or move such loads, as such equipment is rarely used.

Figure 16:
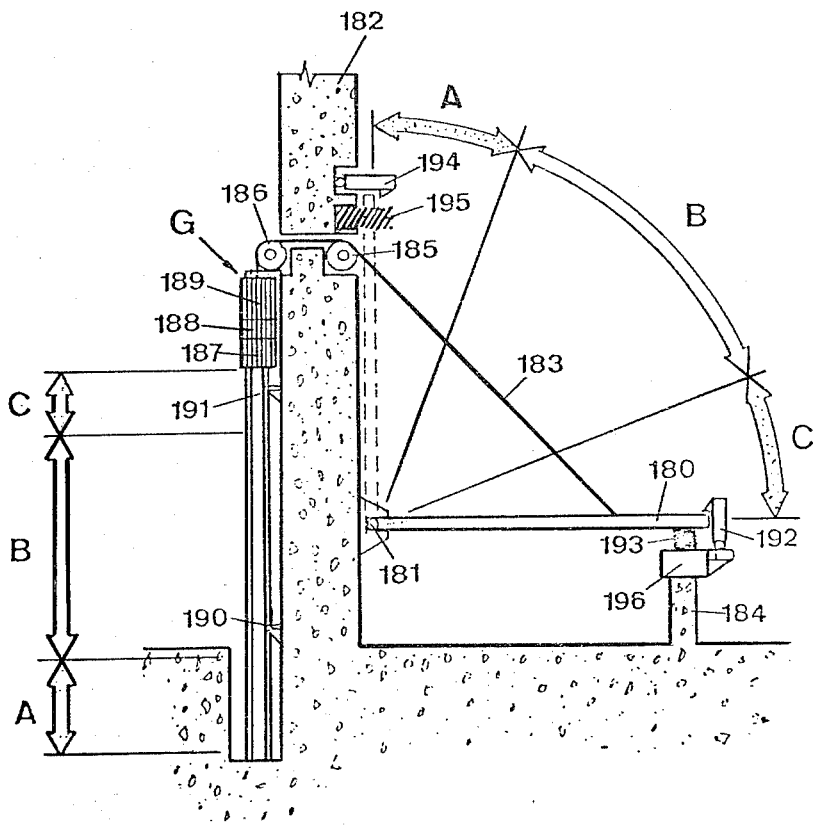
FIG. 16 is an independently operating system for lifting and lowering a load with a counterweight system of the invention.

FIG. 16 illustrates an embodiment of such a counterweight system of the kind previously shown in FIG. 14, where the load is a pivoting member 180, that pivots at one end about a horizontal shaft 181 and is supported in a vertical wall 182 Pivoting member 180 can be raised by means of a cable 183 from the horizontal position shown in solid lines, where it is seated in a rest 184, to the vertical position shown in dashed lines. Cable 183 is guided over two pulleys 185, 186 and at its other ends is fastened to a variable counterweight G′ which may be of any of the previously described designs. For simplicity the counterweight shown, G, is divided only into three partial weights 187, 188, 189, of which the lowermost, 187, is solidly connected with the cable 183, while the two upper partial weights 188, 189 can slide with respect to the cable 183; projections 190 and 191 are solidly mounted at suitable heights so that they retain the partial weights 188 and 189 respectively in their descent and thereby do vary the effective counterweight. Quite clearly counterweight G might also be divided into a larger number of partial weights as in the embodiment of FIG. 14.

A locking system 192 is mounted to rest 184 to keep the pivoting member 180 in the horizontal position; for simplicity this locking system is shown as a pivotably supported ratchet into which engages the pivoting member 180 automatically during its descent and from which it can be released by means not shown. A spring 193 is so mounted to rest 184 that it will be compressed by pivoting member 180 when engaged in ratchet 192. A second locking system 194 in the form of a retractable pivoting ratchet is mounted to the wall 182 in such manner that it keeps the pivoting member 180 in the vertical position, and a second spring 185 is so mounted to wall 185 that it will be compressed by the pivoting member 180 when latter engages ratchet 194.

This counterweight system operates as follows:

It is assumed that the components are in the positions shown in solid lines in FIG. 16. The pivoting member 180 is horizontal, compresses spring 193 and latches with ratchet 192; the counterweight G is in its highest position, for which the upper two partial weights 188, 189 rest on the lowermost 187, whereby the sum of the three partial weights 187, 188, 189 acts as counterweight on the cable 183. This sum is such that its tension on the cable 183 exceeds the opposing force exerted by the pivoting member 180 when in its horizontal position.

Ratchet 192 is disengaged when pivoting member 180 is to be lifted. In that case the pivoting member 180 is positively accelerated on one hand by the expansion of spring 193 and on the other by the excess of tension exerted by counterweight G. The pivoting member 180 therefore moves through the angular range C with increasing speed and upward, while the counterweight G moves a corresponding distance C downward.

After passing through the range C, the uppermost partial weight 189 hits projection 191 which retains it. Therefore only the two partial weights 187 and 188 remain effective as counterweight in the next region B. These two partial weights are so selected that the pivoting member 180 moves at approximately constant speed within the region B. As previously explained in relation to FIG. 14, this condition cannot be precisely met when using a pivoting member with a constant counterweight, because the static force exerted by this pivoting member does vary constantly; however an accurate observation of constant speed in this middle region is not significant at all, but if somehow desired, an arbitrarily close approximation could be achieved by further subdivision of the counterweight G into a larger number of partial weights.

At the boundary of region B, the partial weight 188 in turn is retained by projection 190, whereby only partial weight 187 remains as counterweight. This partial weight is so selected that its tension exerted on cable 183 is less than the opposing force exerted in the upper angular range A by pivoting member 180 on the cable 183; therefore pivoting member 180 experiences a deceleration (a downward acceleration) in the upper angular range A, whereby it approaches the vertical position with decreasing speed. The deceleration however is so selected that pivoting member 180 still has appreciable speed when reaching spring 195, the residual kinetic energy sufficing to compress the spring 195 to such an extent the pivoting member 180 can latch into ratchet 194.

Hence the pivoting member was lifted exclusively by the action of the counterweight G; the lifting can take place in a very short time, as suitable selection of the partial weights can make the positive acceleration in region C quite large, so that the motion in region B takes place at high speed. Nevertheless, due to the deceleration in region A, the pivoting member 180 gently slides into the upper final position.

The kinetic energy imparted to the pivoting member 180 in region C is mostly stored as potential energy in the pivoting member 180 in its upper final position; a small part of the kinetic energy is stored as spring energy in spring 195, which thereby acts as an energy storage.

To move the pivoting member 180 from the vertical final position into the lower horizontal final position, no more need be done than unlatching the upper ratchet 194. The energy stored in spring 195 suffices to impart an initial acceleration to the pivoting member 180. The moment this pivoting member 180 has left the vertical position, the weight of the member no longer acts through its center of rotation, consequently, a clockwise load moment is caused which steadily increases as the member continues to rotate clockwise. The combined effect of this moment and the member's kinetic energy exceeds the restraining effect of the lowermost partial weight 187 so that a downward or negative acceleration is imparted in the pivoting member region A. Therefore the pivoting member 180 moves with increasing speed in region A as it descends. At the end of region A, the partial weight 188 is lifted off projection 190 and dragged along, whereby the two partial weights 187 and 188 again act as counterweight. The pivoting member 180 therefore moves with approximately constant speed downward through region B. At the end of region B, the uppermost partial weight 189 at last is caught, so that again the entire counterweight is effective again, and an upward deceleration is experienced by the pivoting member 180 in region C. This pivoting member 180 therefore softly enters its lower final position, while its speed and hence kinetic energy when reaching spring 193 remains high enough to compress the spring enough for the pivoting member 180 to latch with ratchet 192.

The parts therefore assume again the position shown in FIG. 16, and the processes described will repeat when unlatching the ratchet 192.

If the described system were lossless, the described processes could be repeated at will without requiring the supply of external energy. In actuality however losses are encountered by friction, air resistance, etc., which must be made good externally.

A particular advantage offered by the system described by FIG. 16 is that the energy required to make good losses need not be supplied necessarily during the lifting or lowering of the load, rather it can be delivered during pauses in operation and stored during them. As in general pauses in operation are much longer than the periods of duty, the energy input can be spread over long times, so that relatively little power will suffice. Accordingly small and economical equipment are enough to cover the energy losses, so that it is possible to move a heavy load in a short time, that is, to provide high power output.

Various possibilities can be exploited to supply and store the additional energy.

In a first embodiment, use is made of the presence of stored energy in springs 193 and 195. It is sufficient then to store additional energy in these springs by additional stressing.

To that end, for instance underneath spring 193, a power-actuated system 196, for instance a hydraulic piston, may be used to lift the lower end of the spring 193. When thereby the parts assume the positions shown in FIG. 16, and the lower end of spring 193 is raised, the spring 193 will be additionally compressed, thereby engaging the amount of stored energy. When the pivoting member 180 is released by unlatching the ratchet 192, this additionally stored energy is imparted to the pivoting member 180 in the form of kinetic energy. Part of this additional energy may be used to compensate for the losses during the lifting motion. The remainder is available as additional kinetic energy at the end of the upward motion and allows employing correspondingly stiffer spring 195 which thus shall store more energy, the excess of the energy used up in the losses being then available for the descent. After expansion of the spring 193, the hydraulic piston is put back into its rest position, so that a new storage of additional energy may take place during the next operational cycle. It is also selectively possible to equip spring 195 with a hydraulic piston for the storing of additional energy.

Because the variable counterweight G itself is a storer of energy, the additional energy required to cover the losses also may be put into the counterweight. This can be implemented in that the weight of the counterweight at its highest position (corresponding to the lowest position of the load) is temporarily made larger and/or in that the weight of the counterweight at its lowest position (corresponding to the highest position of the load) is made temporarily smaller. The first step is equivalent to increasing the potential energy stored in the counterweight; the additional potential energy, is transformed into kinetic energy after the load is released, because a larger initial acceleration is imparted to the counterweight at the beginning of the ascent. The second step is equivalent to increasing the potential energy in the load, with the result of increased initial acceleration at the beginning of the descent and hence additional kinetic energy. The additional energy so imparted to the system can always be used to cover the losses.

Figures 17A, 17B, 17C:
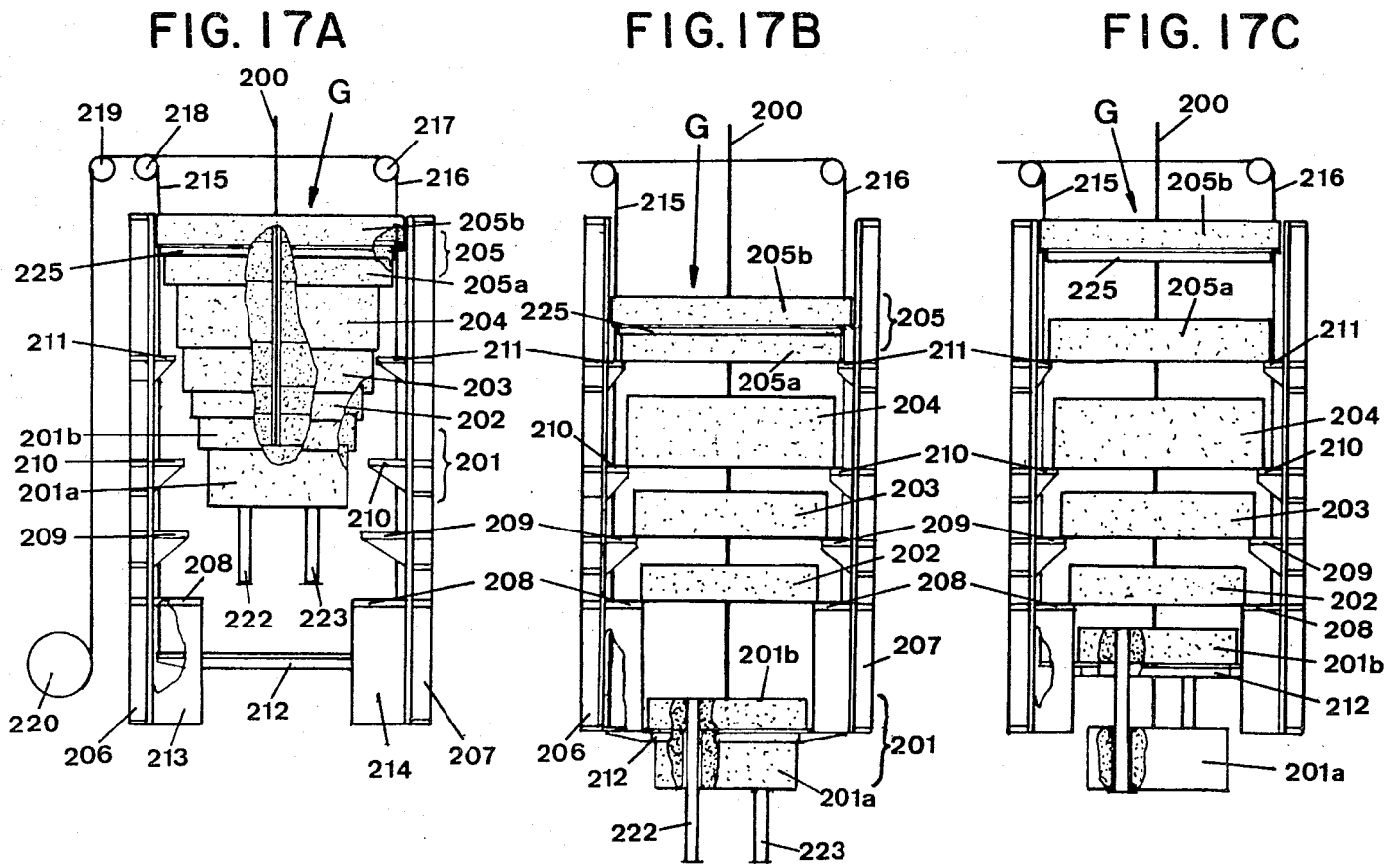
FIG. 17 is an embodiment of the counterweight system of the invention for an independently operating system of the kind shown in FIG. 6.
Figure 18:
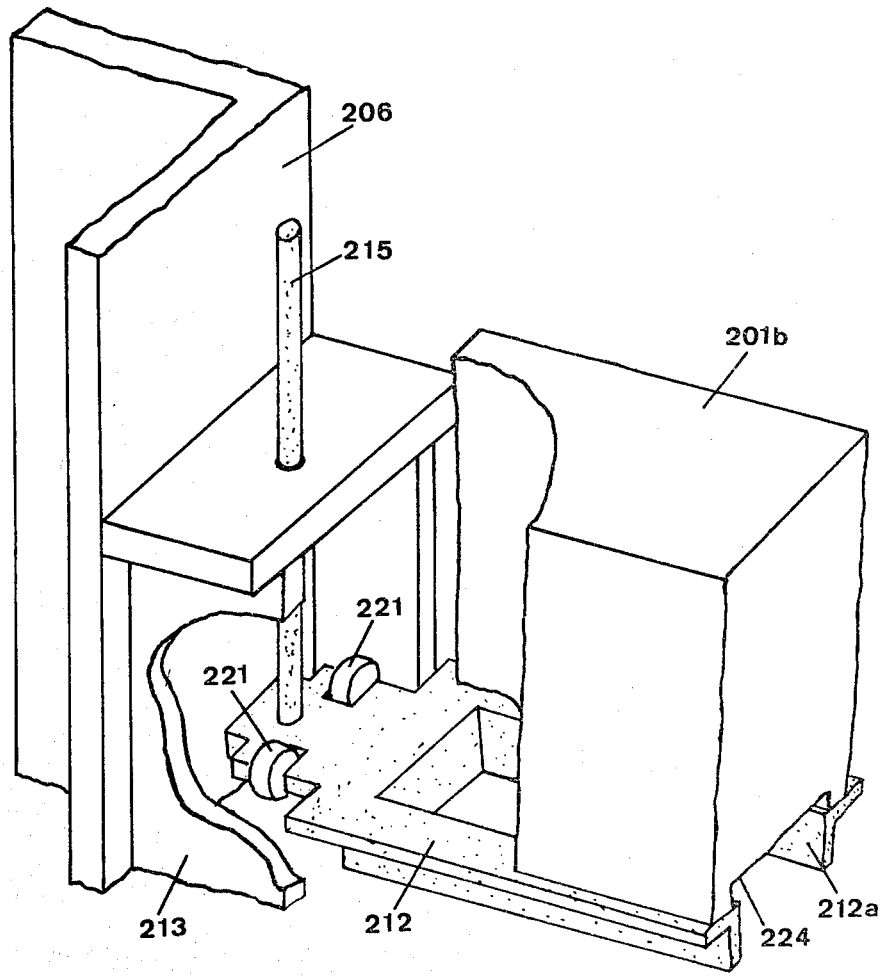
FIG. 18 is a perspective partial view of a component of the counterweight system of FIG. 17.

FIGS. 17 and 18 show a counterweight system which operates in this manner.

FIG. 17 shows a counterweight system in schematic sideview and in three operational positions, based on the design principles explained in relation to FIGS. 5 and 6. The counterweight G acting on cable 100 is divided into five partial weights 201, 202, 203, 204, 205 which are most clearly seen in FIG. 17*b*, where they are distinctly separated. They are of different transverse dimensions as in FIGS. 5 and 6, so that each partial weight 205, 204, 203, 202 slightly projects on both sides the one immediately below it, namely 204, 203, 202 and 201 respectively. The lowermost partial weight 201 is suspended from cable 200, while the other partial weights 202, 203, 204, 205 can slide with the respect to that cable.

As was the case for FIGS. 5 and 6, the guideway consist of two vertical, sideways supports 206, 207 with projections 208, 209, 210, 211 mounted to them at various heights and protruding by different magnitudes into the paths of the partial weights, so that the projections 211 will retain the upper partial weight 205, while projections 210 will retain the partial weight 204, the projections 209 retaining partial weight 203 and projections 208 the partial weight 202 (FIG. 17*b*).

The design of the counterweight of FIG. 17 described so far corresponds to the embodiment of FIGS. 5 and 6 and by itself would result in the operation deceived in relation to those figures.

The particularity of the counterweight system of FIG. 17 consists however in that the lowest partial weight and the highest partial weight each are divided into two parts which can be adjusted vertically with respect to each other, and in that provision is made for devices by means of which the upper part can be raised by a limited amount with respect to the lower part.

The lowest partial weight 201 consists of two parts 201*a* and 201*b*, of which 201*a* is solidly connected to the cable 200 while the upper part 201*b* rests on the lower one 201*a* and can slide with respect to cable 200. The cross-section of the upper part 201*b* is somewhat larger than that of lower part 201*a*, whereby 201*b* projects on all sides slightly beyond the lower part 201*a*; the transverse dimension of part 201*b* however is smaller than the separation between the projections 208, so that the entire partial weight can pass between them.

A lifting frame 212 is supported in the lower region of the guideway in two guide shafts 213, 214 so as to be capable of moving up and down over a limited range. The lifting frame 212 is suspended from two lifting cables 215, 216 passing along the posts 206, 207 and over return rollers 217, 218, 219 to a winch 220, so that this lifting frame can be raised and lowered by means of that winch 220.

As shown by the enlarged partial view in perspective of FIG. 18, the lifting frame 212 comprises an aperture 212*a* which is smaller than the cross-section of the upper part 201*b* of partial weight 201, so that this part 201*b* will rest on the lifting frame 212 when lowered to its height. The aperture 212*a* is adapted to the cross-section of the lower part 201*a* and of such dimensions that it allows said lower part to freely slide through it. The lifting frame 212 is provided with guide rollers 221 on both sides, by means of which it is guided in the guidance shafts 213, 214.

Additional steps are taken to always keep the two parts 201*a* and 201*b* of the lowermost partial weight 201 in the proper mutually opposite positions. To that end two vertical guide rods 222, 223 projecting downward are fastened to the upper part 201*b*, which are guided in sliding manner through guide slots in the lower part 201*a*. Furthermore a flat recess 224 is provided in the lower side of upper part 201*b*, into which fits the lower part 201*a*. Corresponding flat recesses may also be provided in the remaining partial weights, as indicated by the cut-out view in FIG. 17*a*.

Similarly the uppermost partial weight 205 is divided into two parts 205*a* and 205*b* which can move both relative to each other and to cable 200 along the vertical. The upper part 205*b* at all sides projects slightly beyond the lower part 205*a*. Another lifting frame 225 is supported in the upper section of the guideway above the projections 211 between the vertical supports 206, 207 so as to be movable up and down within a given range. The lifting frame 225 comprises an aperture which is somewhat smaller than the cross-section of the upper part 205*b* of partial weight 205, while the lower part 205*a* can freely slide through the aperture of lifting frame 225. This lifting frame also is fastened to the hoisting cables 215, 216, so that it is raised or lowered together with lifting frame 212 when the winch 220 is actuated.

If it is assumed that the cable 200 is connected in lieu of cable 183 in FIG. 16 with the pivoting member 180 shown therein, then the functioning of the counterwieght system of FIG. 17 is as follows:

The pivoting member 180 is in the position shown by the solid horizontal lines, in which it latches with ratchet 192. The counterweight G assumes its highest position (FIG. 17*a*), in which all the upper partial weights 202, 203, 204, 205 rest on that partial weight, 201, which is the lowermost and which is connected with cable 200, so that the sum of all the partial weights acts as the counterweight.

In this position the lower lifting frame 212 is load-less, since it doesn't matter whether it is being raised or lowered. If on the other hand the upper lifting frame 225, as shown in FIG. 17*a*, is raised, then it will bear the upper part 205*b* of the uppermost partial weight 205, and accordingly this part no longer contributes to the effective weight of the counterweight.

The lifting frames 212 and 225 are lowered into their low positions during the operational stillstand prior to unlatching the ratchet 192, whereby the effective weight of the counterweight G is enlarged by the weight of part 205*b*.

When the ratchet 192 is released, an initial acceleration is imparted to the pivoting member 180, which corresponds to the sum of all complete partial weights 201, 202, 203, 204, 205 including the upper part 205*b* of partial weight 205.

The further processes in the raising of pivoting member 180 take place in the manner already described; the effective weight of counterweight G thereby is decreased stepwise, namely because partial weights 205, 204, 203, 202 are sequentially retained by projections 211, 210, 209, 208.

The two parts 201*a* and 201*b* of the lowermost partial weight 201 can move together downward in the last phase of motion (sector A of FIG. 16), that is, after the partial weight 202 has been retained, while lifting frame 212 assumes its lowest position (FIG. 17*b*). Therefore in this phase of the motion the entire weight of the two parts 201*a* and 201*b* of the lowest partial weight 201 are fully effective as counterweight.

When lastly the pivoting member 180 latches with the upper ratches 194 (dashed position in FIG. 16), all the parts of the counterweight system assume the position shown in FIG. 17*b*.

During the ensuing operational pause prior to unlatching the ratchet 194, the two lifting frames 212 and 225 are raised by means of winch 220 into their upper positions. As part 201*b* rests on lifting frame 212 and part 205*b* on lifting frame 225, these two parts are dragged along when the lifting frames are raised (FIG. 17*c*). The energy required to raise parts 201*b* and 205*b* must be supplied by winch 220.

Therefore when ratchet 194 is unlatched, the parts of the counterweight system assume the position shown in FIG. 17*c*. Initially during the descent (sector A in FIG. 16) only the lower part 201*a* of partial weight 201 is effective as the counterweight. Therefore higher acceleration and hence higher kinetic energy is imparted to the pivoting member 180 than if the full partial weight 201 were to act as counterweight.

As the lower part 201*a* reaches the height of the lifting frame 212, it drags along the upper part 201*b*, whereby all of the partial weight 201 is now effective. Henceforth the further processes in the descent of pivoting member 180 go on as described before. In particular the effective weight of the counterweight is increased stepwise because the partial weights 202, 203, 204, 205 are sequentially lifted and carried along by projections 208, 209, 210, 211.

During the last phase of motion however (sector C of FIG. 16) only the lower part 205*a* of partial weight 205 still contributes to the effective weight of the counterweight, because the upper part 205*b* already was lifted into the upper final position.

When at last the pivoting member 180 has again reached the horizontal position and has latched to ratchet 192, the components of the counterweight system again resume their initial positions shown in FIG. 17*a*. The described cycle can be repeated as often as desired.

It is clear at once that the energy required to raise the component weights 201*b* and 205*b* by the height corresponding to the lift of the lifting frames 212 and 225 is supplied in each cycle to the system. This energy is available to cover losses due to friction, air resistance etc.

Besides this energy input from which 220, the described system operates entirely autonomously. In particular the lifting and the lowering of the load takes place only on account of the exchange of energy between load and counterweight. Because of the varying effective weight of the counterweight, appreciable accelerations may be employed, whereby even heavy loads may be raised and lowered in short times. The appreciable power required to that end however remains within the system and need not be applied from the outside. The power input for the additional energy on the other hand can be very small because sufficient times is available during the operational pauses. In other words: the raising of weight parts 201*b* and 205*b* by means of winch 220 can take place very slowly, and accordingly a weak motor suffices to drive winch 220.

I claim:

1. A variable counterweight system comprising a load which is subjected to varying static and dynamic forces during movement, a counterweight assembly adapted to counteract the varying forces acting on the load during its movements, movement means interconnecting the load and counterweight assembly and being fixedly attached to the load, said counterweight assembly including plural separate counterweight segments, one segment only being fixedly attached to the movement means and the remaining segments of the counterweight assembly being movably connected with said movement means, and spaced rigid interceptor means separate from the movement means and fixedly positioned relative to the path of movement of the movement means for supporting said remaining segments along the path of movement of the movement means and acting on said remaining segments one at a time in succession during movement of the movement means in one direction to completely isolate each segment from the load thereby varying the effectiveness of the counterweight assembly as a function of its position in relation to the load.

2. A variable counterweight system as defined in claim 1, and said movement means comprising a drivable flexible suspension element for said load.

3. A variable counterweight system as defined in claim 2, and said counterweight assembly segments being of unequal sizes and progressively increasing in size along the flexible suspension element in one direction, and said interceptor means comprising a guideway for the flexible suspension element and counterweight assembly having rigid abutments for said remaining segments in the paths of movements thereof in one direction with the movement means.

4. A variable counterweight system as defined in claim 3, and said flexible suspension element having a vertical movement path and said guideway having a vertical axis, said counterweight assembly segments progressively increasing in size upwardly with only the lowermost and smallest segment being fixed to said flexible suspension element, and said spaced rigid abutments progressively increasing in width upwardly.

5. A variable counterweight system as defined in claim 4, and said abutments comprising stepped surfaces within said guideway engageable with marginal portions of said segments, said segments being recessed in corresponding end faces for nesting while out of engagement with said stepped surfaces and resting upon the lowermost and smallest segment.

6. A variable counterweight system as defined in claim 3, and interceptor springs positioned between said rigid abutments and opposing parts of said segments.

7. A variable counterweight system as defined in claim 3, and said interceptor means comprising relatively stationary parallel guide bars for said segments having positive stops for the segments fixed thereon at different levels for the respective segments except the one segment only which is attached to the movement means.

8. A variable counterweight system as defined in claim 3, and said interceptor means comprising guide bars having stops individual to said segments and attached to the individual segments of progressively increasing size away from the smallest segment, the guide bars for the largest segment being attached to a relatively stationary support.

9. A variable counterweight system as defined in claim 1, and said movement means comprising a rockable arm member, and said spaced interceptor means comprising a plurality of relatively stationary rests for said remaining segments located on spaced arcs centered on the rocker axis of said rockable arm.

10. A variable counterweight system as defined in claim 1, and said spaced interceptor means comprising a spring-urged pivoted interceptor element on each of said remaining segments and being biased toward an active interceptor position, and a coacting guideway means for said remaining segments having spaced interceptor pockets adapted to receive the pivoted interceptor elements.

11. A variable counterweight system as defined in claim 10, and the interceptor elements comprising plates which progressively increase in width along the guideway means and the spaced interceptor pockets correspondingly increase in width so that only one plate of proper width can enter one pocket of proper width.

12. A variable counterweight system as defined in claim 11, and each pocket having an inclined cam face and a bottom interceptor ledge for the corresponding plate, and a cam follower means on each plate engageable with said cam face of the corresponding pocket.

* * * * *